United States Patent [19]

Krulwich

[11] 4,179,105

[45] Dec. 18, 1979

[54] MAGNETIC PRESS FOR VISES

[76] Inventor: Lester S. Krulwich, 241 Central Park West, New York, N.Y. 10024

[21] Appl. No.: 935,969

[22] Filed: Aug. 22, 1978

[51] Int. Cl.[2] ..... B25B 11/00

[52] U.S. Cl. ..... 269/8; 269/271

[58] Field of Search ..... 269/8, 271, 275, 276, 269/282; 100/DIG. 17

[56] References Cited

U.S. PATENT DOCUMENTS 1,498,638 6/1924 Periolat ..... 269/282

FOREIGN PATENT DOCUMENTS 283847 10/1952 Switzerland ..... 269/276

*Primary Examiner*—Robert C. Watson

[57] ABSTRACT

A magnetic press for metal and woodworking vises in the form of a projection extending from but unattached to a flat plate to which magnetic tape is attached enabling the flat plate to adhere removably to a vise jaw. The flat plate contains magnets that repel other magnets fastened to a rigid plate that is attached to the projection with limited freedom of movement. The projection is provided with different caps and a base. When the vise jaws are drawn towards each other the repelling magnets are compressed exerting additional pressure on a workpiece by the projection. The workpiece is mounted on a small platform capable of magnetically adhering to the opposite jaw and sliding back when on the forward end of the projection.

1 Claim, 6 Drawing Figures

MAGNETIC PRESS FOR VISES

This invention relates to a magnetic press for vises. Vises presently available relate to holding or clamping and not primarily to exerting pressure but many ordinary jobs require a strong press for bending, separating, shaping, starting drill holes, fastening and other tasks. Apparatus like an arbor press are expensive, complex mechanically and not obtainable in any ordinary hardware store. This invention provides a magnetic press for conventional metal and wood vises that is about as strong or stronger than a half ton arbor press.

An important object of this invention is to provide a powerful press that is removably attachable to the jaws of a conventional metal and woodworking vise.

Another object of this invention is to provide an easily operated and relatively inexpensive press removably attachable to conventional vises.

Another object of this invention is to provide a press for vises with a structure that operates without the complicated mechanism of presently available presses.

Another object of this invention is to provide a press for vises with magnetic devices that reinforce the power of the press making its strength comparable to expensive, standard presses.

Further objects and structural details of the invention will be apparent from the following description when read in conjunction with accompanying drawings forming a part of this specification, wherein.

Figure 1:
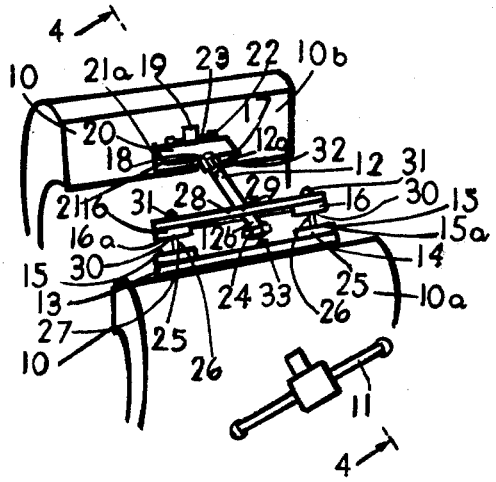
FIG. 1 is a perspective view of an embodiment of my invention between the jaws on the upper portion of a conventional vise before the jaws have been drawn together.
Figure 2:
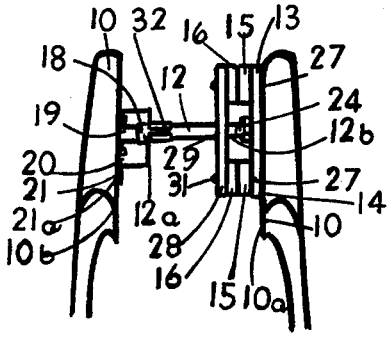
FIG. 2 is a perspective view, partially elevated, with the jaws drawn towards each other and the forward end of the projection engaging the workpiece.
Figure 3:
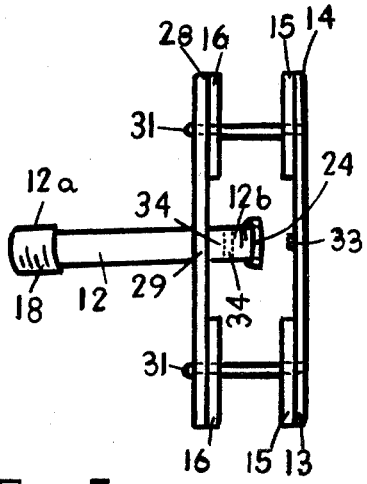
FIG. 3 is a top view of the magnetic press, off the vise and before the repelling magnets have been compressed.
Figure 4:
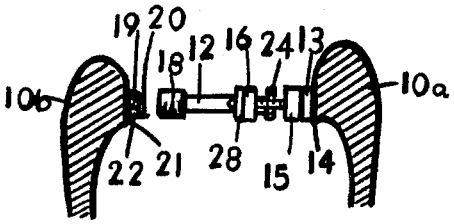
FIG. 4 is a section on line 4—4 of FIG. 1.
Figure 5:
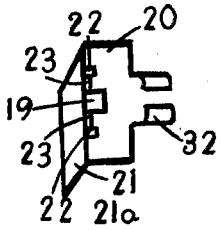
FIG. 5 is a perspective view of the platform.
Figure 6:
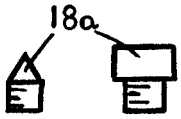
FIG. 6 is a front view of two other caps.

Upon reference to the drawings it will be noted that they show a magnetic press for metal and woodworking conventional vises having two parallel flat faced jaws 10 and a handle 11 that brings the jaws 10 together or apart. The magnetic press contains a projection 12 extending from but unattached to a flat plate 13 provided with magnetic tape 14 that removably adheres to a jaw **10*a* of the vise. The flat plate 13 contains magnets 15 that repel other magnets 16 attached to the projection 12 urging the projection 12 forcefully towards the other jaw 10*b* of the vise when the jaws 10 are drawn towards each other. The projection 12, preferably tubular with outside threading 17 at both ends, contains a removable cap 18 on its forward end 12*a* capable of engaging a workpiece 19. The cap 18 may be changed for one of a different shape suitable for engaging a particular workpiece 19. A small removable platform 20 is provided with a magnetic backing 21 capable of magnetically adhering to the opposite vise jaw 10*b* and supporting a workpiece 19. The platform 20 is optionally slidingly attachable to the forward end 12*a* of the projection 12 so as to move back when the platform 20 approaches and adheres to the opposite jaw 10*b*. The opposite jaw 10*b* is optionally provided with two small magnets 22 having thin extending pieces 23 to help maintain the position of the workpiece 19**.

The projection 12 is preferably of tubular iron or steel about 1½ inches long and ⅜ inch wide, such as a nipple, with a small base 24, which may be a hexagonal nut, fastened on its back end **12*b*. The small base 24 is even with and does not extend out beyond the end 12*b* of the projection 12. The projection 12 extends outward in a right angular line to both parallel jaws 10 unattached to either of them and perpendicularly off from the middle of the flat plate 13 which is preferably rectangular and of sheet iron. The flat plate 13 is magnetically attachable, by suitable means, to the back vise jaw 10*a*, for example by thin magnetic rubber tape 14 fastened to the back of the flat plate 13**.

Towards each longitudinal side of the flat plate 13 a flat magnet 15 having a central hole 25 is attached. The magnets 15 are spaced sufficiently apart so that the back end **12*b* of the projection 12 with its small base 24 is able to move in between them and set against the flat plate 13. A post 26 or other suitable holding means extends perpendicularly outward from the surface of each of said magnets 15, for example flat headed machine screws through the holes 25 in the magnets 15 and through the flat plate 13 with their heads 27 even or below the surface of the magnetic rubber tape 14**.

The projection 12 has fastened to it by suitable means a rigid plate 28, preferably rectangular, midway 29 of and through said rigid plate 28, so that said plate 28 extends longitudinally outward, right angularly from the projection 12 and parallel with the flat plate 13. Flat magnets 16 with center holes 30 are attached by suitable means on the side of the rigid plate 28 facing the magnets 15 attached on the flat plate 13 and are aligned with them. The magnets 16 on the rigid plate 28 have their surfaces **16*a* with the same magnetic poles as the surfaces 15*a* of the magnets 15 facing them on the flat plate 13, thereby repelling each other. The posts 26 pass freely through the holes 30 in the magnets 16 on the rigid plate 28 and freely through each side of the rigid plate 28 allowing movement of that plate 28 with its attached magnets 16 thereby carrying the repelling magnetic force from the flat plate 13 to the projection 12 on which the rigid plate 28 is attached. The posts 26 have heads 31 such as cap nuts on their forward ends and are sized so that when the jaws 10 are drawn towards each other and the projection 12 is pressed inward by the opposing jaw 10*b* and workpiece 19 the back end 12*b* of the projection 12 with its small base 24 is pressed against the flat plate 13 that is magnetically adhering to its jaw 10*a* and the repelling surfaces 15*a*,16*a*of the magnets 15,16 are squeezed approximately together forcefully increasing the forward pressure of the projection 12**.

Fastened on the forward end of the projection 12 is a cap 18 preferably removably threaded. The cap 18 is preferably of iron or steel and other caps **18*a* are provided with different front formations such as triangular, round and rectangular suitable for effective pressure on particular workpieces 19**.

A small platform 20 for the workpieces 19 is optionally provided consisting preferably of a flat magnetically attractable piece such as sheet iron bent down right angularly with the portion bent down 21 being magnetic, for example having attached to it a strip of magnetic rubber tape **21*a*, whereby the bent portion 21 is capable of removably and magnetically adhering to the opposing jaw 10*b*. Optionally a portion of the horizontal part of the platform 20 is bent upwards and around 32 to grip the sides of the cap 18 or forward part of the projection 12 so that with the platform 20 placed on the cap 18 or projection 12 it will slide back when the projection 12 engages the workpiece 19 against the opposing jaw 10***b*. Two small magnets 22 with extensions 23 are optionally provided to hold the workpiece 19 in position.

OPERATION OF THE APPARATUS

Before insertion, the magnets 15,16 on the posts 26 are spaced apart with their magnetic repulsion just felt and with the back end 12*b* of the projection 12 not reaching the flat plate 13. They are initially held in this position by the heads 31 on the posts 26 which also stabilize the apparatus when handling and inserting in the vise.

With the jaws 10 of the vise open the flat plate 13 with its attached magnetic rubber tape 14 is placed on and adheres to the jaw 10*a*. When the handle 11 draws the jaws 10 towards each other the back end 12*b* of the projection 12 sets on the flat plate 13 and the repelling magnets 15,16 are forced towards each other until their opposite surfaces 15*a*,16*a* touch or are near each other. This not only increases the force of the projection 12 on the workpiece 19 in the vise but acts as a starting compressing force that adds to the power of the press. The magnetic rubber tape 14 on the flat plate 13 contributes to this compression and is sufficiently thin, for example 1/16 inch thick, and strong not to tear under pressure. The magnetic structure triangularly widens the effective base of the projection 12.

One of the other caps 18*a* can be fastened on the front 12*a* of the projection 12 according to the kind of workpiece 19, such as for riveting, shaping or bending. For other or added repulsion a magnet 33 may be attached on the flat plate 13 repelling a magnet 34 fastened in the tubular projection 12 with the same poles facing each other. The magnetism of the various parts can be magnetically integral with those parts.

The platform 20 is magnetically set against the forward jaw 10*b* and the workpiece 19 placed on the platform 20 opposite the front of the projection 12, optionally positioned by the extending pieces 23 of the two small magnets 22. When the portion 32 of the platform 20 movably grips the forward part 12*a* of the projection 12 the workpiece 19 may be set right in front of the projection cap 18. The structure of the magnetic press is sufficiently light and stable so that one hand is free while the other turns the vise handle 11.

I have described preferred embodiments of my invention but it is understood that various changes may be made in the form, details, arrangements and proportions of the various parts without departing from the scope of my invention. What I claim is:

1. A magnetic press for vises provided with two parallel flat faced jaws and a handle comprising magnets fastened on a flat plate removably attached to a jaw of the vise, said magnets having their magnetic poles the same as those on the opposite faces of magnets attached to a projection aligned movably and right angularly to said plate, thereby repelling said magnets with said projection towards the jaw opposite said flat plate with increasing compression as the jaws are drawn towards each other by the vise handle.

* * * * *